US007458945B2

(12) United States Patent
Zemont

(10) Patent No.: US 7,458,945 B2
(45) Date of Patent: Dec. 2, 2008

(54) HEALTHY BODY BALL

(76) Inventor: Cheryl E. Zemont, P.O. Box 91482, Tucson, AZ (US) 85752

( * ) Notice: Subject to any disclaimer, the term of this patent is extended or adjusted under 35 U.S.C. 154(b) by 947 days.

(21) Appl. No.: 10/612,521

(22) Filed: Jul. 2, 2003

(65) Prior Publication Data

US 2004/0006294 A1 Jan. 8, 2004

Related U.S. Application Data

(63) Continuation-in-part of application No. 09/905,741, filed on Jul. 12, 2001, now abandoned.

(51) Int. Cl.
*A61H 15/00* (2006.01)

(52) U.S. Cl. ..... 601/131; 601/134

(58) Field of Classification Search ..... 473/595, 473/596, 614; 601/131, 135, 134
See application file for complete search history.

(56) References Cited

U.S. PATENT DOCUMENTS

| | | | | | |
|---|---|---|---|---|---|
| 744,718 | A | * | 11/1903 | Cassidy | 601/131 |
| 2,078,382 | A | * | 4/1937 | Hanshaw | 473/595 |
| 2,309,475 | A | * | 1/1943 | Palmieri | 446/240 |
| 2,466,470 | A | | 4/1949 | Norris | |
| 3,411,498 | A | * | 11/1968 | Reiter | 601/136 |
| 4,191,178 | A | | 3/1980 | Wisnieski | |
| 4,309,038 | A | * | 1/1982 | Spoon | 473/596 |
| 4,796,616 | A | * | 1/1989 | Panahpour | 601/131 |
| 5,218,955 | A | | 6/1993 | Gueret | |
| D344,591 | S | | 2/1994 | Zhuang | |
| D396,110 | S | | 7/1998 | Kang | |
| 5,843,005 | A | | 12/1998 | Chubinsky | |
| 5,926,985 | A | * | 7/1999 | Arbuckle | 40/657 |
| 6,013,042 | A | * | 1/2000 | Sakai | 601/134 |

FOREIGN PATENT DOCUMENTS

| | | | |
|---|---|---|---|
| DE | 198 15 302 A 1 | | 10/1999 |
| DE | 299 13533 | * | 1/2000 |
| EP | 0320958 | * | 12/1988 |
| FR | 2483225 | * | 5/1980 |
| JP | 238066 | * | 6/1994 |
| WO | WO 89/05622 | | 6/1989 |

* cited by examiner

*Primary Examiner*—Michael A. Brown
(74) *Attorney, Agent, or Firm*—Gavin J. Milczarek-Desai; Quarles & Brady LLP

(57) ABSTRACT

A method for performing trigger point therapy using a massage device having a spherical ball with an array of pliable nodes that project axially from the surface of the ball. The massage device can be manipulated by the user or a second person. Effective manipulation to the user's back and neck are achieved when the user places the device between himself and a rigid surface and rolls the ball at a trigger point location.

10 Claims, 2 Drawing Sheets

HEALTHY BODY BALL

CROSS-REFERENCE TO RELATED APPLICATION

This application is a continuation-in-part of U.S. patent application Ser. No. 09/905,741, filed Jul. 12, 2001 now abandoned by the same inventor.

BACKGROUND OF THE INVENTION

1. Field of the Invention

This invention relates to the field of massage therapy, specifically, to massage devices useful for topical manipulation to determine the location of irritated trigger-points and with point-of-pressure applications to reduce the attendant pain.

2. Description of the Prior Art

Trigger point therapy is one of the largest and fastest growing muscle therapies today. Janet Travell, M.D., the White House physician under former President John F. Kennedy, and Dr. David Simons initially coined the phrase "trigger point therapy" to describe their then cutting-edge treatments involving saline injections into muscle, stretches, and heat therapy to resolve trouble spots. Travell used these techniques to treat JFK's back pain. In the 1970's, Bonnie Prudden advanced Travell and Simons's methods by developing a system of non-invasive techniques, which are widely used today by professional athletes, massage therapists, and physical therapists.

Trigger points are areas of pain in or around muscles that usually radiate pain in a predictable pattern. When a person is injured, the muscle automatically contracts around the painful site to support and protect the area. If the pain is resolved, the muscles can relax. However, if the pain persists, muscles can become continually contracted. Sometimes the contractions press on nerves causing tingling, numbness, and more pain. Like a compressed sponge, a contracted muscle cannot hold much blood, which deprives it of healthy circulation. Consequently, the muscle does not receive enough oxygen and nutrients, waste products accumulate, and fatigue and soreness results. This effect can also irritate nerves in the area, causing pain to spread beyond the contracted area.

Trigger points are relieved primarily by applying pressure to receptors in the nervous system long enough to deprive the trigger point of its oxygen supply and inactivate muscle spasms. Pressure can be applied with a thumb, finger, knuckle, or elbow depending on the size, depth and thickness of the muscle being compressed. Most trigger points are easy to detect by locating the pain, applying pressure and experiencing the subsequent pain release. However, sometimes, the real source of pain may be a "boss" trigger point located quite a distance from the "satellite" trigger point (the pain site). For example, a boss trigger point for the wrist, forearm and hand may actually be in the region of the shoulder blade. Thus, pain associated with the wrist, forearms and hand may require treatment of the boss trigger point, not the localized satellite point.

There have been many massage therapy devices developed over the time but a limited number of these devices have a functional relationship to applying trigger point therapy. This is due to the relatively brief period that the trigger point therapy has been granted acceptance in the physical therapy field and the precision needed to remove trigger points. An additional requirement for a trigger point massage device used for trigger point therapy is that it must provide sufficient pressure to a specific location. Ideally, massage should be possible without the help of another person.

One example of a massage ball device is disclosed in U.S. Design Pat. No. D419,681 issued to Chen. This design configuration has an array of nodules affixed to a hand-held platform. By design, this device does not have a capability to locate and treat specific irritated trigger points because the multiple nodules are spaced close together on the same plane. This device is used to massage a larger area rather than put pressure at a specific spot in the muscle. In addition, as a hand-held device, it is limited to a user's reachable personal body areas or would require a second person's assistance.

Another example is disclosed in U.S. Pat. No. 5,913,839 issued to Wincek. This device has an array of massage balls positioned and attached to a contoured base board. The fixed-position ball array limits the potential for locating and treating irritated trigger-points because it also cannot focus on a specific trigger point. The user lies in a relatively fixed supine position on the device with the fixed-ball contact positions massaging trigger points in the back and neck. As with Chen, the massage balls are on a horizontal plane and the user cannot easily position himself on the board to focus pressure on a single trigger point. In addition, the device is large and not portable.

Another example is disclosed in U.S. Design Pat. No. D403,076 issued to York. This massage ball design is limited by the fact that it is a hand-held device and can only reach certain body areas or would require a second person's assistance. In addition, the relative size and hardness of the roller-ball configuration offers limited potential to locate and treat specific irritated trigger-points.

An example of a self-massage device is shown in PCT Patent Application No. WO 89/05622 by Mauch consisting of a flexible ball made of a spherical plastic core and a plurality of nodes. A single person can use the massage ball to reach a variety of places by rolling the ball between the person and a rigid surface. But the large number of small nodes means that there are limited spaces between the nodes. Thus, Mauch's device does not allow a person to focus pressure on specific trigger points. In contrast, when placed between a rigid surface and a person, a trigger point therapy device must provide sufficient and localized pressure to release the trigger point.

Morever, unlike any of the above-described simple massage devices that are designed to increase circulation to a contracted area, a trigger point therapy ball is used to limit blood flow (oxygen) at a specific location in order to relax muscle and ease pain.

Prior to the present invention, there has not been a self-massage device specifically designed for trigger point therapy. Therefore, there is a need for a device that allows a single person to focus pressure on specific trigger points on all parts of the body. The device could be used by an individual for a self-massage or an experienced masseuse to provide trigger point therapy.

SUMMARY OF INVENTION

The present invention generally relates to a method for providing trigger point therapy using a spherical ball device possessing a limited number of cylindrical nodes projecting axially from the surface of the device. More particularly, the invention relates to a spherical massage ball having pliable, cylindrical nodes that are especially useful for locating and treating trigger points in the body of the user for relaxation and the relief of pain.

The present invention has been developed with diligent consideration in engineering design and testing to satisfy these major function conditions: 1) Providing for trigger-point therapy with a spherically shaped ball having between eight and fourteen pliable, cylindrical nodes projecting axially from the sphere's surface; 2) providing a device that can be self administered or second-person administered over the known trigger-point areas of the body; 3) providing a spherically shaped device that is rotationally manipulated to investigate, locate, and treat irritated trigger-points; 4) reducing trigger point pain with axially applied pressure through the pliable, cylindrical nodes.

The preferred embodiment is baseball or softball sized with from eight to fourteen pliable, cylindrical nodes projecting axially from the surface of the sphere with flat or radial ends. The invention can be molded from a resilient, rubberized material or fabricated with a plastic ball with axially positioned rubberized nodes.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiments and particularly pointed out in the claims. However, such drawings and description disclose only some of the various ways in which the invention may be practiced.

DESCRIPTION OF THE PREFERRED EMBODIMENTS

The present invention relates to a method for performing trigger point therapy utilizing a massage device having a spherical ball with an array of protruding nodes. Trigger point therapy is defined as a massage technique, technically known as myotherapy, that involves finding "trigger points" in the body and applying pressure to relieve symptoms of muscular pain and discomfort. A trigger point may also include a tight and tender spot in a muscle that refers pain (or "triggers" pain) to other areas of the body. By applying pressure at the trigger point, blood flow is thought to be limited and the trigger point is thereby "released." Consequently, the pain felt at the trigger point and any referred area subsides. The preferred embodiment of the invention uses a massage device to find and release trigger points that could be used by an individual performing a self-massage or a by a second person.

Figure 1:
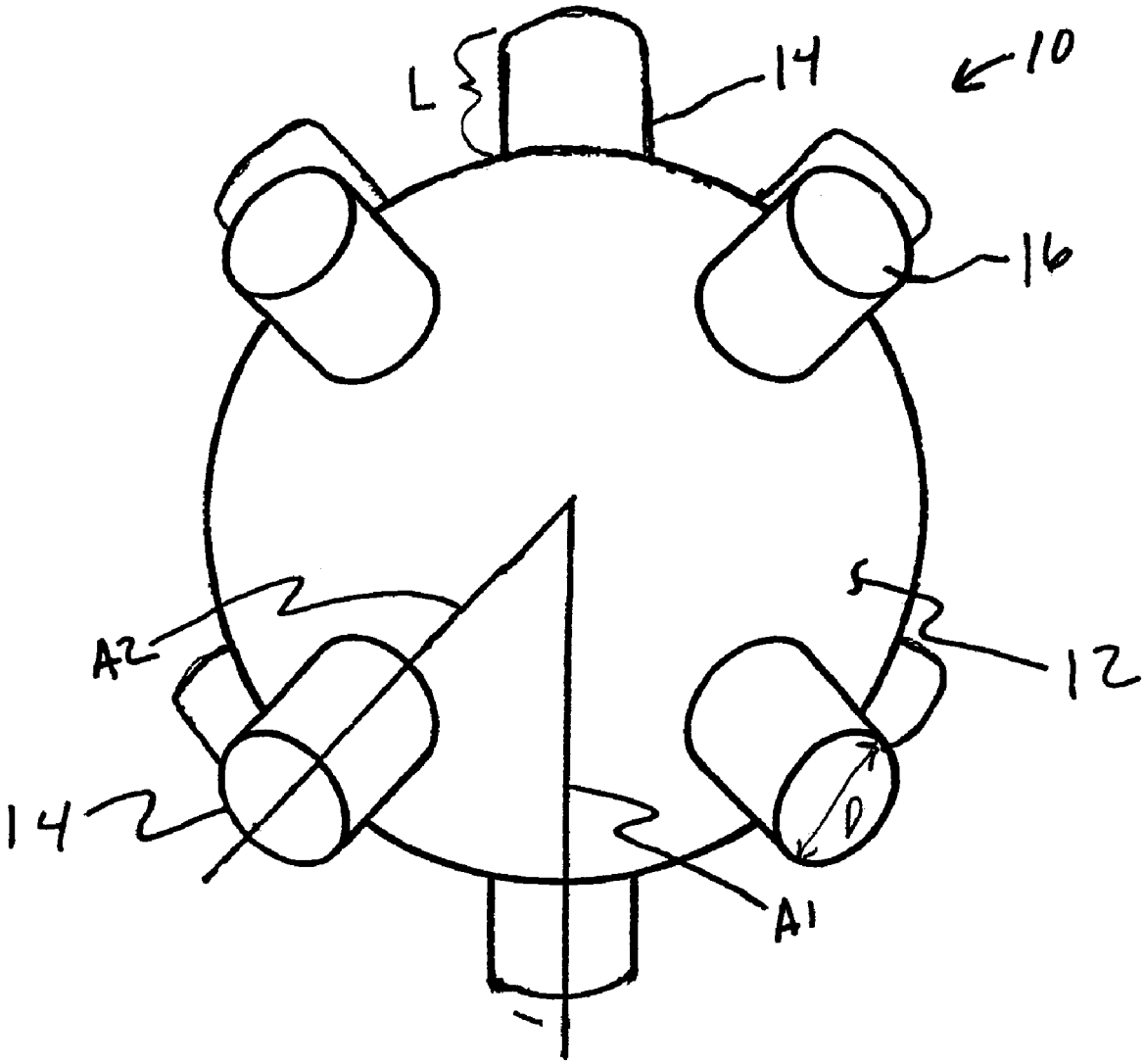
FIG. 1 depicts a slightly rotated (along an axis A1), side perspective view of a 10-node embodiment of the invention.

FIG. 1 illustrates an elevational view of the massage device 10 used in the preferred embodiment. The device 10 comprises a spherical ball 12 with an array of pliable nodes 14 that project axially from the surface of the ball as indicated by, for example, axis A1 and axis A2. The ball and the nodes are made of a flexible and resilient material, such as plastic or rubber. The nodes 14 are cylindrically shaped and preferably positioned evenly spaced on the surface of the spherical ball 12. As shown in FIG. 1, the preferred embodiment includes nodes 14 at the top and bottom of the sphere and pairs of nodes placed across the middle. At the end of each node is a flat end 16, which help provide intense localized pressure at the trigger point. The massage device in FIG. 1 consists of ten nodes, but the number can range from eight to fourteen.

The restricted number and spacing of nodes are due to roll and pressure requirements discovered by the inventor. The nodes must be spaced apart in such a manner to allow the device to roll while searching for trigger points and still provide adequate pressure to find and release them. If the nodes are spaced too far apart, the device will not roll effectively and if the nodes are spaced too close together, the nodes would not provide adequate or localized pressure at the trigger point. Moreover, the number and size of the nodes dictates the spacing between them and the degree of penetration into the body when pressure is applied. Thus, the preferred size of each node is between one-half inch to one inch in both length L and diameter D as shown in FIG. 1.

Figure 2:
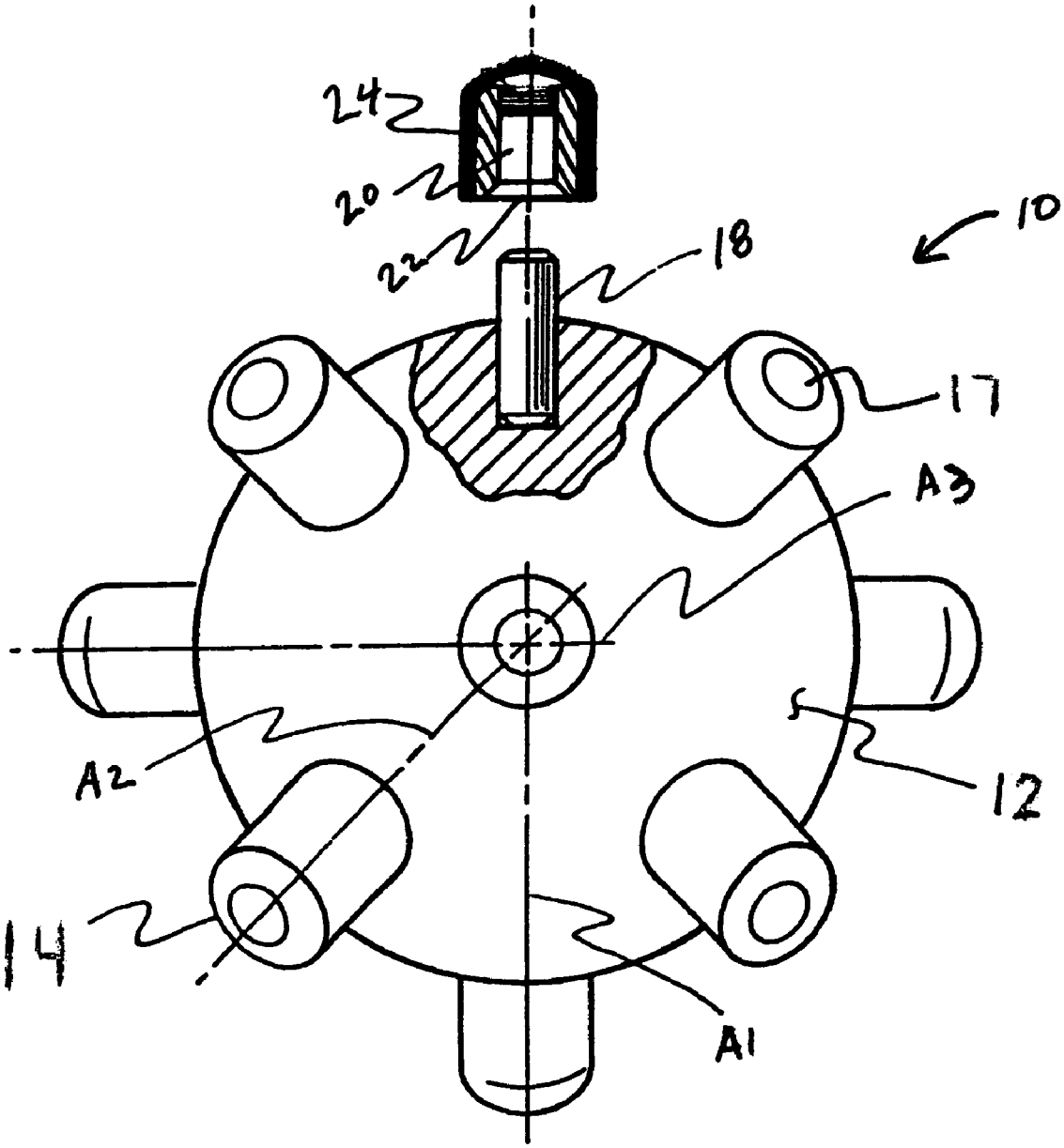
FIG. 2 depicts an elevational view of a 14-node embodiment of the invention.

Turning to FIG. 2, wherein elements identical to those found in FIG. 1 are denoted with like numbers, an alternative embodiment is shown. In this embodiment, the trigger point therapy invention includes a massage device 10 with a spherical ball 12 and fourteen nodes 14 projecting axially from the surface of ball 12 as indicated by, for example, axis A1, axis A2 and axis A3. In a manner described in more detail below, the ball may be rolled upon or rolled over a user's body in order locate and/or apply pressure to trigger points. Due to the position and cylindrical shape of the nodes, the alternative embodiment is especially useful for the application of intense pressure. Another feature of the alternate embodiment is each node has a radial end 17 to apply pressure at the trigger point locations.

Also shown in FIG. 2, the alternative embodiment includes a rigid pin 18 is press-fit to the ball 12 at each node position. The nodes 14 include a slip-fit hole 20 with countersink 22 that matches the pin 18 and cover it with the same flexible, resilient material 24 used for the ball 12. In this embodiment, the nodes become more resilient because of the sturdiness of the pin. When a person presses against the node from an angle, the node does not give way as much and applies increased pressure at the trigger point.

According to the method of the invention, a person rolls the device along areas of discomfort or known trigger point locations. As the device rolls, the nodes provide incremental pressure along the body, thereby soothing tight, tender spots in the muscle. A person can position the device between himself and a rigid surface and roll the device along hard to reach areas, such as the back and shoulders, to find trigger points. When a trigger point is found, the person maneuvers the device in such a manner to apply increased pressure for 10-20 seconds until the trigger point releases.

Although the description above contains many specifics, these should not be construed as limiting the scope of the invention but as merely providing illustrations of some of the presently preferred embodiments of this invention. Thus, the scope of the invention should be determined by the appended claims and their legal equivalents, rather than by the examples given.

What is claimed is:

1. A method for performing a trigger-point massage, comprising the following steps:

(a) providing a spherical ball having an array of between 8 to 14 pliable nodes projecting axially from the surface of the spherical ball, wherein said pliable nodes are substantially cylindrical; and (b) applying localized pressure to a trigger-point using a single pliable node of said spherical ball;

wherein said pliable nodes are between one-half inch to one inch in both length and diameter.

2. The method of claim 1, wherein the spherical ball and pliable nodes are composed of rubber or plastic.

3. The method of claim 1, wherein the pliable nodes of said spherical ball are equally spaced apart from each other.

4. The method of claim 1, wherein the pliable nodes of said spherical ball have a flat end.

5. A trigger-point therapy device, comprising:

a spherical ball; and an array of between 8 to 14 pliable nodes projecting axially from the surface of the spherical ball, wherein said pliable nodes are substantially cylindrical and are between one-half inch to one inch in both length and diameter.

6. The device of claim 5, wherein the spherical ball and the pliable nodes are composed of rubber or plastic.

7. The device of claim 5, wherein the pliable nodes of said spherical ball are evenly spaced apart from each other.

8. The device of claim 5, wherein the pliable nodes of said spherical ball have a flat end.

9. The device of claim 5, wherein at least one of said pliable nodes are disposed upon a rigid pin in press-fit arrangement with said spherical ball.

10. A trigger-point therapy device, comprising:

a spherical ball; and an array of 10 pliable nodes projecting axially from the surface of the spherical ball, wherein said pliable nodes are substantially cylindrical, are evenly spaced apart from each other, and are disposed upon a rigid pin in press-lit arrangement with said spherical ball, wherein said pliable nodes are between one-half inch to one inch in both length and diameter.

* * * * *